US009261114B2

(12) United States Patent
Kim

(10) Patent No.: US 9,261,114 B2
(45) Date of Patent: Feb. 16, 2016

(54) HYDRAULIC PRESSURE-REGULATING VALVE FOR CONSTRUCTION EQUIPMENT

(75) Inventor: Jin-Wook Kim, Changwon-si (KR)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 412 days.

(21) Appl. No.: 13/641,318

(22) PCT Filed: May 17, 2010

(86) PCT No.: PCT/KR2010/003095

§ 371 (c)(1),
(2), (4) Date: Oct. 15, 2012

(87) PCT Pub. No.: WO2011/145754

PCT Pub. Date: Nov. 24, 2011

(65) Prior Publication Data

US 2013/0032233 A1 Feb. 7, 2013

(51) Int. Cl.

*E02F 9/22* (2006.01)
*F15B 11/04* (2006.01)
*F15B 13/04* (2006.01)

(52) U.S. Cl.

CPC ..... *F15B 11/04* (2013.01); *E02F 9/2239* (2013.01); *E02F 9/2267* (2013.01); *E02F 9/2282* (2013.01); *F15B 13/0402* (2013.01);
(Continued)

(58) Field of Classification Search

CPC ..... E02F 9/2239; E02F 9/2267; E02F 9/2282; F15B 13/0402; F15B 11/04
USPC ..... 91/444, 446, 447, 448; 137/596
See application file for complete search history.

(56) References Cited

U.S. PATENT DOCUMENTS 3,295,551 A * 1/1967 Malott ..... 137/596
3,952,510 A 4/1976 Pererson
7,263,924 B2 * 9/2007 Ioku ..... 91/447
(Continued)

FOREIGN PATENT DOCUMENTS

EP 0596140 A1 5/1994
JP 58217869 A 12/1983
(Continued)

OTHER PUBLICATIONS

Preliminary Examination Report by IPEA dated Dec. 14, 2011 for PCT/KR2010/003095.
(Continued)

*Primary Examiner* — Nathaniel Wiehe
*Assistant Examiner* — Abiy Teka
(74) *Attorney, Agent, or Firm* — Hauptman Ham, LLP

(57) ABSTRACT

A hydraulic control valve for a construction machine is provided. The hydraulic control valve includes a boom spool slidingly coupled into a valve block to be shifted to control the hydraulic fluid supplied from a first hydraulic pump and a second hydraulic pump to the actuator and provided with an internal path, a supply path of the first hydraulic pump and a supply path of the second hydraulic pump which are formed to be vertically symmetrical about the boom spool, check valves elastically supported to open and close the supply path of the first hydraulic pump and the supply path of the second hydraulic pump, respectively, bridge paths formed to be horizontally and vertically symmetrical with respect to a path formed on a sliding surface of the valve block to supply the hydraulic fluid, cylinder paths supplying the hydraulic fluid from the first hydraulic pump to the actuator.

14 Claims, 5 Drawing Sheets

(52) U.S. Cl.
CPC ..... *F15B2211/20576* (2013.01); *F15B 2211/30565* (2013.01); *Y10T 137/86493* (2015.04)

(56) References Cited

U.S. PATENT DOCUMENTS

| | | | | |
|---|---|---|---|---|
| 2005/0097887 | A1* | 5/2005 | Landhuis | 60/464 |
| 2009/0101854 | A1* | 4/2009 | Jeon | 251/63 |

FOREIGN PATENT DOCUMENTS

| | | | |
|---|---|---|---|
| JP | 59034076 | A | 2/1984 |
| JP | 02248705 | A | 10/1990 |
| JP | 6-137304 | | 5/1994 |
| JP | 7-110007 | | 4/1995 |
| JP | 2009-103304 | | 5/2009 |
| KR | 0-0814499 | B1 | 3/2008 |
| KR | 10-0814499 | | 3/2008 |
| WO | 01/57405 | A1 | 8/2001 |

OTHER PUBLICATIONS

Written Opinion Report by ISA mailed Jan. 26, 2011 for PCT/KR2010/003095.
International Search Report mailed Jan. 26, 2011 for PCT/KR2010/003095.
China office action of CN 201080066460.4 dated Jul. 2, 2014.
European Patent Office Search Report of PCT/KR2010/003095 mailed Mar. 19, 2014.
Japanese Office Action of JP 2013-511087 Mailed Mar. 25, 2014.

* cited by examiner

HYDRAULIC PRESSURE-REGULATING VALVE FOR CONSTRUCTION EQUIPMENT

TECHNICAL FIELD

The present invention relates to a hydraulic control valve for a construction machine on which working devices, such as a boom and an arm, are mounted. More particularly, the present invention relates to a hydraulic control valve for a construction machine, which can increase the driving speed of working devices, such as a boom and an arm, by making hydraulic fluid that will be supplied to actuators of the working devices in a confluent state when the working devices are driven.

BACKGROUND ART

In general, a hydraulic control valve is used to control hydraulic fluid that is supplied from hydraulic pumps to actuators that drive working devices, such as a boom and an arm, of a construction machine, such as an excavator. Particularly, in driving working devices, such as the boom and the arm, the driving speed of the working devices can be increased by making the hydraulic fluid supplied from a plurality of hydraulic pumps in a confluent state.

A hydraulic control valve for a construction machine in the related art, as shown in FIGS. 1 and 2, includes a first boom block 1 forming a supply path therein to supply hydraulic fluid of a first hydraulic pump P1 to a boom cylinder 6; a second boom block 2 making close contact with the first boom block 1 to be vertically symmetric to the first boom block 1 and forming a supply path therein to supply hydraulic fluid of a second hydraulic pump P2 to the boom cylinder 6; a first boom spool 3 installed in the supply path 16 of the first hydraulic pump P1 to be shifted to control a start, stop, and direction change of the boom cylinder 6; a second boom spool 4 installed in the supply path 31 of the second hydraulic pump P2 to be shifted to make the hydraulic fluid of the second hydraulic pump P2 join the hydraulic fluid of the first hydraulic pump P1 to increase the driving speed of the boom cylinder 6; and poppets 9 elastically supported by springs 8, respectively, to open and close the supply path 16 of the first hydraulic pump P1 and the supply path 31 of the second hydraulic pump P2.

In the drawing, the reference numerals "12" and "15" denote guides on which springs 13 are seated, which are oppositely fixed to end portions of the first boom spool 3 and the second boom spool 4, and "14" denotes stoppers arranged between the guides 12 and 15 of the first boom spool 3 and the second boom spool 4, respectively, to limit strokes of the first boom spool 3 and the second boom spool 4.

Hereinafter, the operation of the hydraulic control valve as constructed above will be described.

(A) The operation of the hydraulic control valve during a boom-up operation will be described.

As shown in FIG. 1, if pilot signal pressure (pressure that exceeds the predetermined set pressure of a spring 13) for a boom-up operation is supplied to a pilot b port 28 of the cover 10 to lift up the boom, the first boom spool 3 that is slidingly coupled in the first boom block 1 is shifted to the left side.

At this time, the high-pressure hydraulic fluid in the supply path 16 of the first hydraulic pump P1 pushes the poppet 9 that is elastically supported by the spring 8 upward to be supplied to the bridge path 17, and is supplied to the cylinder path 19 through a notch 18 of the first boom spool 3 that is shifted to the left side.

At the same time, as the pilot signal pressure (pressure that exceeds the predetermined set pressure of the spring 13) for the boom-up operation is supplied to a pilot b' port 29 of the cover 10, the second boom spool 4 that is slidingly coupled in the second boom block 2 is shifted to the left side.

At this time, the high-pressure hydraulic fluid in the supply path 31 of the second hydraulic pump P2 pushes the poppet p that is elastically supported by the spring 8 downward to be supplied to the bridge path 32, and is supplied to the cylinder path 34 through a notch 33 of the second boom spool 4 that is shifted to the left side.

The hydraulic fluid supplied to the cylinder path 34 joins the hydraulic fluid in the cylinder path 19 on the side of the first boom block 1, and then is supplied to a large chamber of the boom cylinder 6 through an actuator B port 20 and a boom large chamber path 21. Through this, the boom is lifted up.

At this time, leakage of the high-pressure hydraulic fluid is prevented by an O-ring 36 provided on a mutual close-contact surface of the first and second boom blocks 1 and 2.

On the other hand, the hydraulic fluid that returns from a small chamber of the boom cylinder 6 passes through the boom small chamber path 22, the actuator A port 23, and the cylinder path 24 in order, and returns to the tank path 26 through the notch 25 of the first boom spool 3 that is shifted to the left side. Accordingly, the boom is lifted up.

At this time, since the amount of hydraulic fluid that returns from the small chamber of the boom cylinder 6 is equal to or less than a half of the hydraulic fluid of the large chamber, the hydraulic fluid returns to the hydraulic tank only through the first boom spool 3. At this time, in the second boom spool 4 that is shifted to the left side, the notch that communicates with the tank path 37 is not formed, and the hydraulic fluid does not return to the hydraulic tank through the second boom spool 4.

At this time, if the pressure that exceeds the predetermined set pressure is applied to the boom cylinder 6, relief valves 5, which are installed on the actuator A port 23 and the actuator B port 20, make the hydraulic fluid having the excessive pressure return to the hydraulic tank to maintain the predetermined set pressure, and thus the boom cylinder 6 can be protected.

(B) The operation of the hydraulic control valve during a boom-down operation will be described.

As shown in FIG. 1, if pilot signal pressure for a boom-down operation is supplied to a pilot a port 27 and a' port 30, the first boom spool 3 that is slidingly coupled in the first boom block 1 and the second boom spool 4 that is slidingly coupled in the second boom block 2 are shifted to the right side.

At this time, the high-pressure hydraulic fluid in the supply path 16 of the first hydraulic pump P1 pushes the poppet 9 that is elastically supported by the spring 8 upward to be supplied to the bridge path 17, and is supplied to the cylinder path 24 through the notch 38 of the first boom spool 3 that is shifted to the right side.

Further, the high-pressure hydraulic fluid in the supply path 31 of the second hydraulic pump P2 pushes the poppet 9 that is elastically supported by the spring 8 downward to be supplied to the bridge path 32. By contrast, in the second boom spool 4 that is shifted to the right side, the notch that communicates with the bridge path 32 is not formed, and thus the high-pressure hydraulic fluid in the supply path 31 of the second hydraulic pump P2 is not supplied to the cylinder path 39 through the second boom spool 4.

Accordingly, only the hydraulic fluid on the side of the first hydraulic pump P1 is supplied to the small chamber of the boom cylinder 6 through the actuator A port 23 and the boom small chamber path 22.

On the other hand, the hydraulic fluid, which returns from the large chamber of the boom cylinder 6 passes through the boom large chamber path 21, the actuator B port 20, and the cylinder path 19 in order, and then dispersedly returns to the tank path 42 and the tank path 43 through the notch 40 formed on the first boom spool 3 that is shifted to the right side and the notch 41 formed on the second boom spool 4. Accordingly, the boom can lower.

FIG. 2 is a hydraulic circuit diagram of a hydraulic control valve for a construction machine in the related art.

(A) The boom-up operation will be described with reference to the hydraulic circuit.

If the pilot signal pressure for the boom-up operation is supplied to a b port of the first boom block 1, the first boom spool 3 that is coupled to the first boom block 1 is shifted to the right side. At this time, the high-pressure hydraulic fluid in the supply path 16 of the first hydraulic pump P1 pushes a check valve 55, and is supplied to paths 56 and 57 through the internal path of the first boom spool 3 that is shifted to the right side.

At the same time, if the pilot signal pressure for the boom-up operation is supplied to a b' port of the second boom block 2, the second boom spool 4 of the second boom block 2 is shifted to the right side. At this time, the high-pressure hydraulic fluid in the supply path 31 of the second hydraulic pump P2 pushes a check valve 62, and is supplied to a path 63 through the internal path of the second boom spool 4 that is shifted to the right side. Through this, the hydraulic fluid that is supplied to the path 63 joins the hydraulic fluid on the side of the first hydraulic pump P1 in the path 57 and is supplied to the large chamber of the boom cylinder 6.

At this time, the hydraulic fluid that returns from the small chamber of the boom cylinder passes through the path 59, and then is supplied to the tank path 60 through the internal path of the first boom spool 3 that is shifted to the right side.

(B) The boom-down operation will be described with reference to the hydraulic circuit.

If the pilot signal pressure for the boom-down operation is supplied to a port of the first boom block 1 and an a' port of the second boom block 2 to let the boom can lower, the first boom spool 3 of the first boom block 1 and the second boom spool 4 of the second boom block 2 are shifted to the left side, respectively. At this time, the high-pressure hydraulic fluid in the supply path 16 of the first hydraulic pump P1 pushes the check valve 55, and is supplied to a path 59 through the internal path of the first boom spool 3 that is shifted to the left side. Through this, the hydraulic fluid is supplied to the small chamber of the boom cylinder 6.

At this time, the hydraulic fluid that returns from the larger chamber of the boom cylinder 6 is supplied to the paths 57 and 56, and is supplied to the tank path 60 through the internal path of the first boom spool 3 that is shifted to the left side.

At the same time, the hydraulic fluid that returns from the large chamber of the boom cylinder 6 is supplied to the path 63 that is branched to the path 57, and is supplied to the tank path 64 through the internal path of the second boom spool 4 that is shifted to the left side. Through this, the boom can lower.

As described above, the hydraulic control valve in the related art includes the first boom block 1 and the second boom block 2 for the boom-up or boom-down operation, the first boom spool 3 and the second boom spool 4 that are slidingly coupled to the first boom block and the second boom block 2, and the poppets 9 that are elastically supported by the springs 8 to open and close the supply path 16 of the first hydraulic pump P1 and the supply path 31 of the second hydraulic pump P2. Since such construction is applied to a first arm spool and a second arm spool in the same manner, the hydraulic control value becomes large-sized.

Further, in the case of mounting the hydraulic control valve onto the construction machine, the large-sized hydraulic control valve causes inconvenience during piping and layout of the hydraulic control valve which increases the manufacturing cost.

DISCLOSURE

Technical Problem

Therefore, the present invention has been made to solve the above-mentioned problems occurring in the related art, and one embodiment of the present invention is related to a hydraulic control valve for a construction machine, which can be easily mounted on the construction machine and reduce the manufacturing cost thereof by compacting the hydraulic control valve that controls hydraulic fluid supplied to actuators.

Technical Solution

In accordance with one aspect of the present invention, there is provided a hydraulic control valve for a construction machine that controls hydraulic fluid supplied to an actuator, which includes a mono type valve block; a boom spool slidingly coupled into the mono type valve block to be shifted to control the hydraulic fluid supplied from a first hydraulic pump and a second hydraulic pump to the actuator, and provided with an internal path formed in an axis direction thereof; a supply path of the first hydraulic pump and a supply path of the second hydraulic pump which are formed to be vertically symmetrical about the boom spool; check valves elastically supported to open and close the supply path of the first hydraulic pump and the supply path of the second hydraulic pump, respectively; bridge paths formed to be horizontally and vertically symmetrical with respect to a path formed on a sliding surface of the mono type valve block, in which the boom spool is shifted, to supply the hydraulic fluid from the supply path of the first hydraulic pump and the supply path of the second hydraulic pump to the actuator; cylinder paths supplying the hydraulic fluid from the first hydraulic pump to the actuator if the boom spool is shifted to make the cylinder paths communicate with the bridge path; and a connection path supplying the hydraulic fluid from the second hydraulic pump to the internal path of the boom spool if the boom spool is shifted to make the connection path communicate with the bridge path.

The hydraulic control valve, according to the aspect of the present invention, may further include check valves elastically supported to open and close openings formed on both sides of the internal path of the boom spool, wherein the check valve of the opening on the cylinder path side, to which the hydraulic fluid from the supply path of the first hydraulic pump and the supply path of the second hydraulic pump is supplied, is opened to supply the hydraulic fluid to the actuator, and the check valve on the opening of the other side is maintained in a closed state.

The hydraulic control valve according, to the aspect of the present invention, may further include a relief valve installed on actuator ports that communicate with the actuator and the cylinder paths to return the hydraulic fluid having an excessive pressure to a hydraulic tank if the pressure that exceeds a predetermined pressure is generated in the actuator.

The check valve that opens and closes the supply path of the first hydraulic pump may include a plug in which a path that communicates with the supply path of the first hydraulic pump is formed; a poppet elastically supported by a spring to open and close the path, and having slots formed on both side surfaces thereof that slide against the plug; and another poppet sliding to perform a relative motion with respect to the poppet, and elastically supported by the spring to open and close the path formed on the sliding surface of the valve block in which the boom spool is shifted.

The check valve that opens and closes the supply path of the second hydraulic pump may include a plug in which a path that communicates with the supply path of the second hydraulic pump is formed; and a poppet elastically supported by a spring to open and close the path, and having slots formed on both side surfaces thereof that slide against the plug.

The check valve that opens and closes the openings of the internal path of the boom spool may include back chambers formed to communicate with the openings formed on the both sides of the internal path of the boom spool; poppets slidingly coupled into the back chambers and supported to open and close the openings of the internal path; springs elastically supporting the poppets in a closed state by pressing the poppets with respect to the openings of the internal path; and plugs fixed to the boom spool to maintain the predetermined set pressure of the springs.

The hydraulic control valve according to the aspect of the present invention may further include drain paths formed on left and right sides of the boom spool to communicate with the back chambers so as to supply the hydraulic fluid in the supply path of the first hydraulic pump and the supply path of the second hydraulic pump to the actuator through the internal path of the boom spool, wherein if the boom spool is shifted, the drain paths make the back chambers communicate with tank paths to open the poppets from the openings on the both sides of the internal path.

The actuator may be a boom cylinder or an arm cylinder.

Advantageous Effects

As described above, according to the hydraulic control valve according to the aspect of the present invention, the following advantages can be obtained.

Since the hydraulic control valve that is used to perform boom-up and boom-down operations can be small-sized, the hydraulic control valve can be easily mounted on a small swing radius construction machine or the like, and the manufacturing cost can be reduced to secure the price competitiveness.

BRIEF DESCRIPTION OF THE DRAWINGS

The above objects, other features and advantages of the present invention will become more apparent by describing the preferred embodiments thereof with reference to the accompanying drawings, in which.

DESCRIPTION OF REFERENCE NUMERALS IN THE DRAWING

Figure 1:
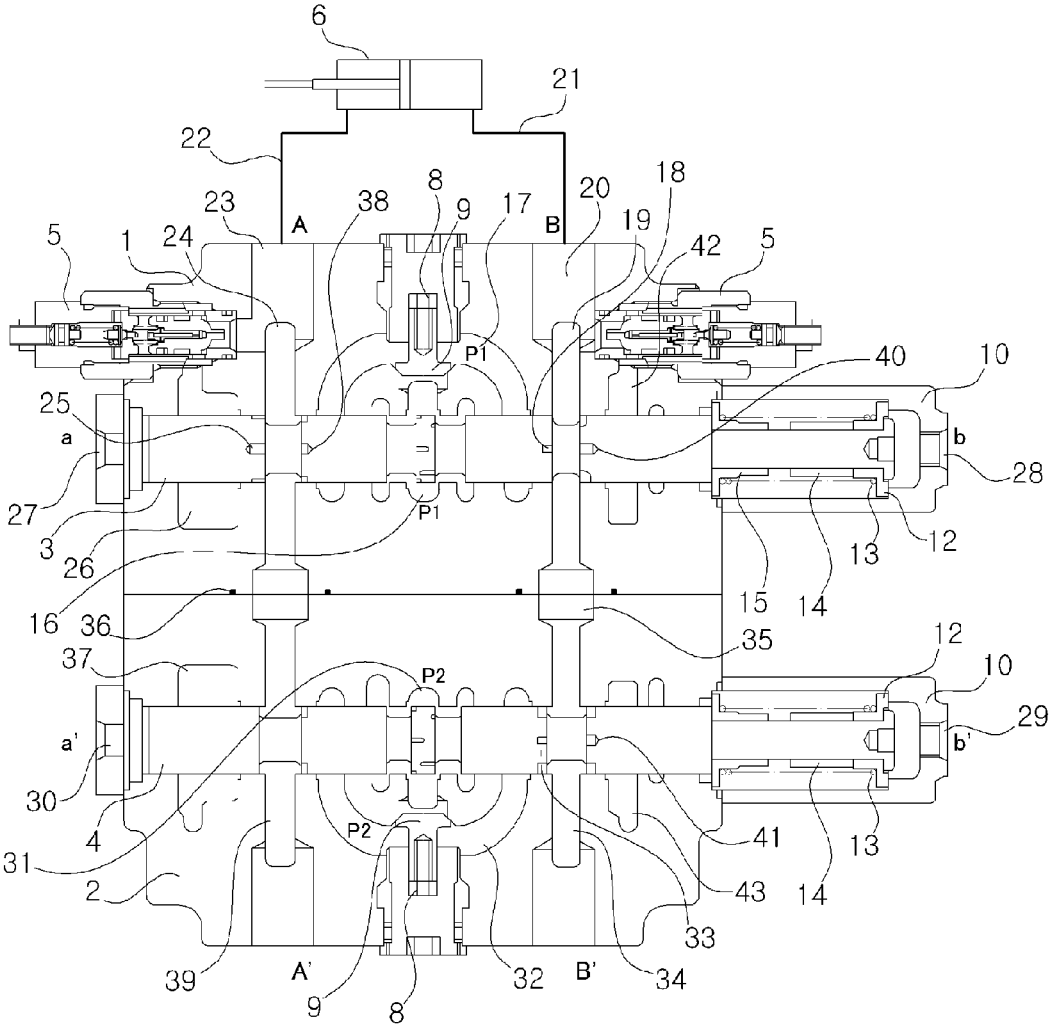
FIG. 1 is a cross-section view of a hydraulic control valve for a construction machine in the related art.
Figure 2:
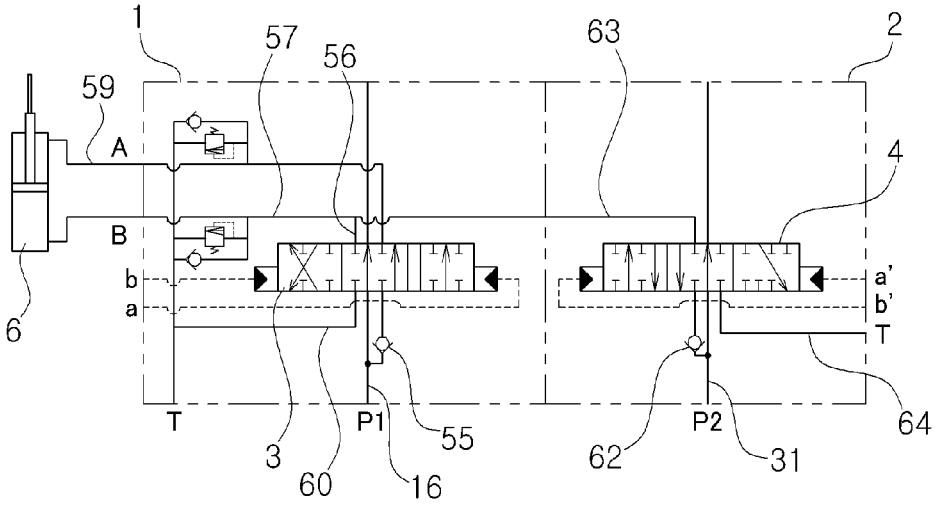
FIG. 2 is a hydraulic circuit diagram of a hydraulic control valve for a construction machine in the related art.

5: relief valve
6: actuator
19, 24: cylinder path
101: valve block
102: boom spool
104, 106, 108, 110, 113: poppet
105, 109, 111, 114: spring
116: supply path of the second hydraulic pump
117, 119: bridge path
118: supply path of the first hydraulic pump
120: connection path
125: internal path
135, 136: back chamber
A, B: actuator port

Best Mode

Now, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

Figure 3:
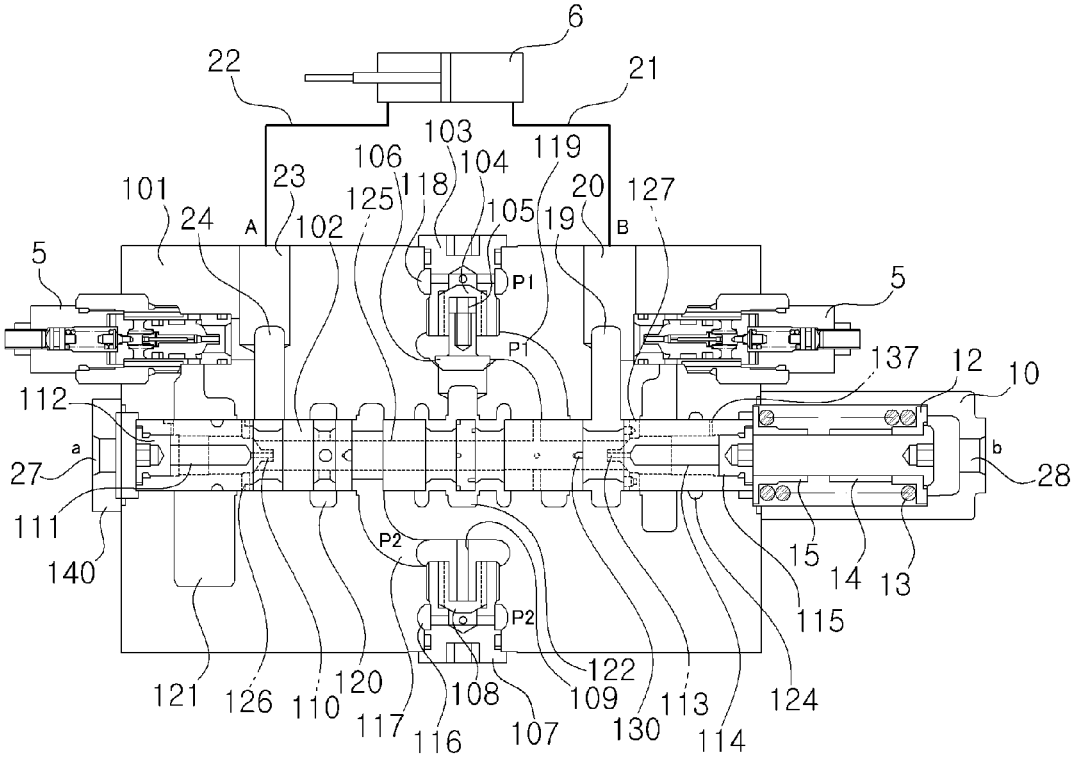
FIG. 3 is a cross-sectional view of a hydraulic control vale for a construction machine according to an embodiment of the present invention.
Figure 4:
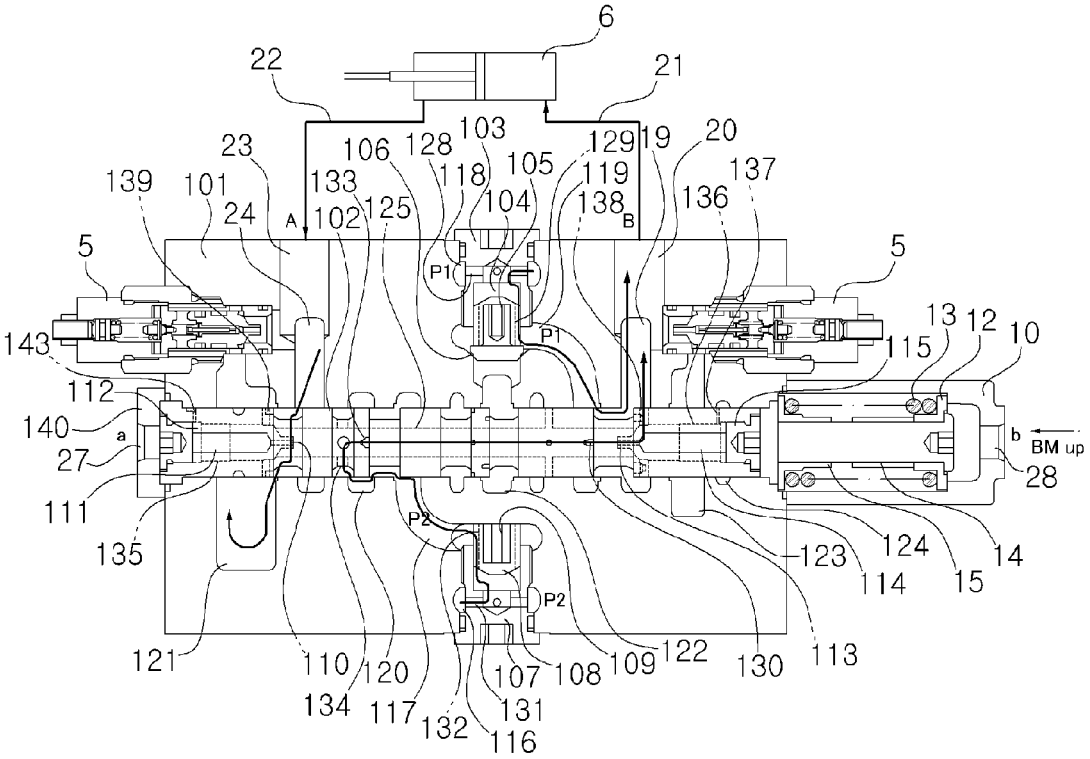
FIG. 4 is a view illustrating a boom-up operation of a hydraulic control valve for a construction machine according to an embodiment of the present invention.
Figure 5:
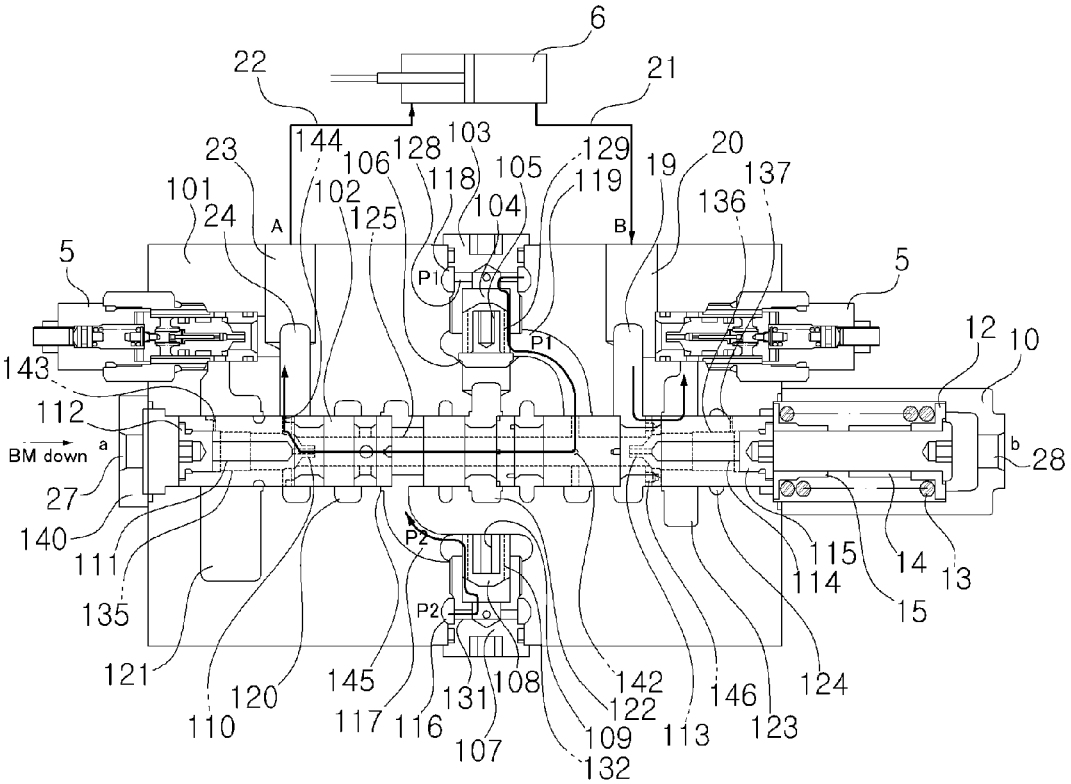
FIG. 5 is a view illustrating a boom-down operation of a hydraulic control valve for a construction machine according to an embodiment of the present invention.

According to an embodiment of the present invention as illustrated in FIGS. 3 to 5, there is provided a hydraulic control valve for a construction machine that controls hydraulic fluid supplied to an actuator (for example, boom cylinder), which includes a mono type valve block 101; a boom spool 102 slidingly coupled into the mono type valve block 101 to be shifted to control the hydraulic fluid supplied from a first hydraulic pump P1 and a second hydraulic pump P2 to the actuator 6, and provided with an internal path 125 formed in an axis direction thereof; a supply path 118 of the first hydraulic pump P1 and a supply path 116 of the second hydraulic pump P2 which are formed to be vertically symmetrical about the boom spool 102; check valves (for example, poppets are used) 104 and 108 elastically supported by springs 105 and 109 to open and close the supply path 118 of the first hydraulic pump P1 and the supply path 116 of the second hydraulic pump P2, respectively; bridge paths 119 and 117 formed to be horizontally and vertically symmetrical with respect to a path 122 formed on a sliding surface of the mono type valve block 101, in which the boom spool 102 is shifted, to supply the hydraulic fluid from the supply path 118 of the first hydraulic pump P1 and the supply path 116 of the second hydraulic pump P2 to the actuator 6; cylinder paths 19 and 24 supplying the hydraulic fluid from the first hydraulic pump P1 to the actuator 6 if the boom spool 102 is shifted to make the cylinder paths 19 and 24 communicate with the bridge path 119; and a connection path 120 supplying the hydraulic fluid from the second hydraulic pump P2 to the internal path 125 of the boom spool 102 if the boom spool 102 is shifted to make the connection path 120 communicate with the bridge path 117.

The hydraulic control valve according to an embodiment of the present invention further includes check valves 110 and 113 elastically supported by springs 111 and 114 to open and close openings formed on both sides of the internal path 125 of the boom spool 102, wherein the check valve of the opening on the side of the cylinder paths 19 and 24, to which the hydraulic fluid from the supply path 118 of the first hydraulic pump P1 and the supply path 116 of the second hydraulic pump P2 is supplied, is opened to supply the hydraulic fluid to the actuator, and the check valve of the opening on the other side is maintained in a closed state.

The hydraulic control valve, according to an embodiment of the present invention, further includes a relief valve 5 installed on actuator ports 20 and 23 that communicates with the actuator 6 and the cylinder paths 19 and 24 to return the hydraulic fluid having an excessive pressure to a hydraulic tank (not illustrated) if the pressure that exceeds a predetermined pressure is generated in the actuator 6.

The check valve that opens and closes the supply path 118 of the first hydraulic pump P1 may include a plug 103 in which a path 128 that communicates with the supply path 118 of the first hydraulic pump P1 is formed; a poppet 104 elastically supported by a spring 105 to open and close the path 128, and having slots 129 formed on both side surfaces thereof that slide against the plug 103; and another poppet 106 sliding to perform a relative motion with respect to the poppet 104, and elastically supported by the spring 105 to open and close the path 122 formed on the sliding surface of the valve block 101 in which the boom spool 102 is shifted.

The check valve that opens and closes the supply path 116 of the second hydraulic pump P2 may include a plug 107 in which a path 131 that communicates with the supply path 116 of the second hydraulic pump P2 is formed; and a poppet 108 elastically supported by a spring 109 to open and close the path 131, and having slots 132 formed on both side surfaces thereof that slide against the plug 107.

The check valve that opens and closes the openings of the internal path 125 of the boom spool 102 may include back chambers 135 and 136 formed to communicate with the openings formed on the both sides of the internal path 125 of the boom spool 102; poppets 110 and 113 slidingly coupled into the back chambers 135 and 136 and supported to open and close the openings of the internal path 125; springs 111 and 114 elastically supporting the poppets 110 and 113 in a closed state by pressing the poppets 110 and 113 with respect to the openings on both sides of the internal path 125; and plugs 112 and 115 fixed to the boom spool 102 to maintain the predetermined set pressure of the springs 111 and 114.

The hydraulic control valve, according to the aspect of the present invention, further includes drain paths 143 and 137 formed on left and right sides of the boom spool 102 to communicate with the back chambers 135 and 136 so as to supply the hydraulic fluid in the supply path 118 of the first hydraulic pump P1 and the supply path 116 of the second hydraulic pump P2 to the actuator 6 through the internal path 125 of the boom spool 102, wherein if the boom spool 102 is shifted, the drain paths 143 and 137 make the back chambers 135 and 136 communicate with tank paths 121 and 124 to open the poppets 110 and 113 from the openings on the both sides of the internal path 125.

In the hydraulic control valve, according to an embodiment of the present invention, as illustrated in FIGS. 3 to 5, the same reference numerals are given to the same configurations as those of the hydraulic control valve in the related art as illustrated in FIG. 1, such as the actuator 6 and the like, and the detailed description thereof will be omitted.

Hereinafter, the operation of the hydraulic control valve for a construction machine, according to an embodiment of the present invention, will be described.

(A) The operation of the hydraulic control valve during a boom-up operation will be described.

As shown in FIGS. 3 and 4, if pilot signal pressure (pressure that exceeds a predetermined set pressure of a spring 13) for a boom-up operation is supplied to a pilot b port 28 of the cover 10 to lift up the boom, the boom spool 102 that is slidingly coupled in the mono type valve block 101 is shifted to the left side. At this time, the boom spool 102 moves within a distance until a stopper 14 that is fixed to the circumference of the boom spool 102 becomes in close contact with guides 12 and 15.

At this time, since high-pressure hydraulic fluid in the supply path 118 of the first hydraulic pump P1 is supplied to the path 128 formed on the plug 103, the poppet 104 that is elastically supported by the spring 105 moves downward and makes contact with the poppet 106 (shown in FIG. 4).

Accordingly, the hydraulic fluid supplied to the path 128 is supplied to the bridge path 119 through the slot 129 formed on the side sliding surface of the poppet 104, and then is supplied to the cylinder path 119 through the notch 130 of the boom spool 102 that has been shifted to the left side (indicated by a curved arrow in FIG. 4). At this time, the poppet 106 that is elastically supported by the spring 105 to open and close the path 122 moves upward and the hydraulic fluid on the side of the path 122 is supplied to the bridge path 119.

On the other hand, since the high-pressure hydraulic fluid in the supply path 116 of the second hydraulic pump P2 mounted on a lower end portion of the mono type valve block 101 is supplied to the path 131 formed on the plug 107, the poppet 108 that is elastically supported by the spring 109 moves upward and makes contact with the inner surface of the bridge path 117.

Through this, the hydraulic fluid that is supplied to the path 131 is supplied to the bridge path 117 through the slot 132 formed on the side sliding surface of the poppet 108, and then is supplied to the connection path 120 through the notch 133 of the boom spool 102 that has been shifted to the left side.

The hydraulic fluid supplied to the connection path 120 is supplied to the internal path 125 through the path 134 vertically formed to communicate with the internal path 125 of the boom spool 102. At this time, since the drain path 143 formed on the back chamber 135 is in a clogged state, the pressure formed inside the poppet 110 presses the poppet 110 to the right side.

Through this, the poppet 110 that is elastically supported by the spring 111 in the opening on the left side of the internal path 125 is not opened.

Accordingly, the hydraulic fluid supplied to the internal path 125 of the boom spool 102 flows to the right side along the internal path 125. At this time, since the drain path 137 communicates with the drain path 124 formed on the valve block 101 to lower the pressure of the back chamber 136, the hydraulic fluid pushes the poppet 113 that is elastically supported by the spring 114 in the opening on the right side of the internal path 125 to the right side. Through this, the hydraulic fluid in the internal path 125 joins the hydraulic fluid in the cylinder path 19 through the path 138 vertically formed to communicate with the internal path 125.

Accordingly, the hydraulic fluid that joins the hydraulic fluid in the cylinder path 19 is supplied to a large chamber of the actuator 6 through the actuator B port 20 and a boom large chamber path 21.

At this time, the hydraulic fluid that returns from a small chamber of the actuator 6 passes through the boom small chamber path 22, the actuator A port 23, and the cylinder path 24 in order, and returns to the tank path 121 through the notch 139 of the boom spool 102 that is shifted to the left side. Accordingly, the boom is lifted up.

(B) The operation of the hydraulic control valve during a boom-down operation will be described.

As shown in FIGS. 3 and 5, if pilot signal pressure (pressure that exceeds the predetermined set pressure of the spring 13) for a boom-down operation is supplied to a pilot a port 27 of the cover 140 to drop the boom, the boom spool 102 that is slidingly coupled in the mono type valve block 101 is shifted to the right side. At this time, the boom spool 102 moves within the set distance until the stopper 14 that is fixed to the circumference of the boom spool 102 comes in close contact with the guides 12 and 15.

Since the high-pressure hydraulic fluid in the supply path 118 of the first hydraulic pump is supplied to the path 128 formed on the plug 103, the poppet 104 that is elastically supported by the spring 105 moves downward and makes contact with the poppet (shown in FIG. 5).

Through this, the hydraulic fluid that is supplied to the path 128 is supplied to the bridge path 119 through the slot 129 formed on the side sliding surface of the poppet 104, and then is supplied to the internal path 125 through the path 142 vertically formed to communicate with the internal path 125 of the boom spool 102 shifted to the right side.

On the other hand, since the drain path 137 formed to communicate with the back chamber 136 is in a clogged state, the pressure formed inside the back chamber 136 of the poppet 113 presses the poppet 113 to the left side. Through this, the poppet 113 that is elastically supported by the spring 111 in the opening on the left side of the internal path 125 is not opened.

Accordingly, the hydraulic fluid supplied from the bridge path 119 to the internal path 125 through the path 142 flow to the left side along the internal path 125. At this time, since the drain path 143, which is formed to communicate with the back chamber 135, communicates with the tank path 121, the pressure of the back chamber 135 is lowed.

Through this, the pressure formed in the internal path 125 pushes the poppet 110, which is elastically supported by the spring 111 in the opening on the left side of the internal path 125, to the left side.

On the other hand, the high-pressure hydraulic fluid of the supply path 116 of the second hydraulic pump P2 pushes the poppet 108, which is elastically supported by the spring 109 through the path 131 of the plug 107, to the left side and makes the poppet 108 in contact with the inner surface of the bridge path 117.

Through this, the hydraulic fluid in the supply path 116 of the second hydraulic pump P2 is supplied to the bridge path 117 through the slot 132 formed on the side sliding surface of the poppet 108. At this time, since the bridge path 117 is clogged by a spool land 145 of the boom spool 102, the hydraulic fluid, which is supplied from the second hydraulic pump P2, is not supplied to the actuator 6 during the boom-down operation.

Accordingly, the hydraulic fluid, which is supplied to the cylinder path 24 through the internal path 125 of the boom spool 102, is supplied to the small chamber of the actuator 6 through the actuator A port 23 and the boom small chamber path 22 in order.

On the other hand, the hydraulic fluid, which returns from a large chamber of the actuator 6, passes through the boom large chamber path 21, the actuator B port 20, and the cylinder path 19 in order, and then returns to the tank path 123 through the notch 146 of the boom spool 102 that is shifted to the right side. Accordingly, the boom can lower.

Although the operation of the hydraulic control valve to perform the boom-up or boom-down operation has been described, it is apparent that the hydraulic control valve can be applied to the arm of the construction machine to make confluence of the hydraulic fluid in the first and second hydraulic pumps P1 and P2 and to increase the driving speed of the arm in the same manner.

As described above, according to the hydraulic control valve for a construction machine, according to an embodiment of the present invention, as described above, the supply paths of the first and second hydraulic pump are formed on the mono type valve block as the hydraulic control valve that controls the hydraulic fluid supplied to the actuator to perform the boom-up or boom-down operation. Accordingly, during the boom-up operation, the confluence of the hydraulic fluid in the first and second hydraulic pumps is made to increase the boom driving speed, and during the boom-down operation, only a part of the hydraulic fluid on the first hydraulic pump side is used to allow the boom to lower by its own weight. Accordingly, the size of the hydraulic control valve can be reduced to cause the reduction of the manufacturing cost, and the hydraulic control valve can be easily mounted on a small swing radius construction machine or the like.

INDUSTRIAL APPLICABILITY

As apparent from the above description, according to the hydraulic control valve for a construction machine, according to the embodiments of the present invention, since the hydraulic control valve that is used to perform boom-up and boom-down operations can be small-sized, the hydraulic control valve can be easily mounted on a small swing radius construction machine or the like, and the manufacturing cost can be reduced.

The invention claimed is:

1. A hydraulic control valve for controlling hydraulic fluid supplied to an actuator in a construction machine, the hydraulic control valve comprising:

a mono type valve block;

a boom spool for actuating a boom, the boom spool slidably coupled to the mono type valve block and configured to be shifted to control the hydraulic fluid supplied from a first hydraulic pump and a second hydraulic pump to the actuator, and comprising an internal path disposed in an axis direction thereof;

wherein the hydraulic pump comprises a first supply path, and the second hydraulic pump comprises a second supply path, and wherein the first supply path and the second supply path are vertically symmetrical with respect to each other about an axis of the boom spool;

first check valves elastically supported, and configured to open or close each of the supply path and the second supply path;

bridge paths disposed to be horizontally and vertically symmetrical with respect to each other about a path disposed on a sliding surface of the mono type valve block, in which the boom spool is shifted, to supply the hydraulic fluid from the first supply path and the second supply path to the actuator;

cylinder paths configured to supply the hydraulic fluid from the first hydraulic pump to the actuator when the boom spool is shifted to a first side to make the cylinder paths communicate with the bridge paths;

a connection path configured to supply the hydraulic fluid from the second hydraulic pump to the internal path of the boom spool when the boom spool is shifted to the first side to make the connection path communicate with the bridge path; and a spool land of the boom spool, the spool land configured to clog the bridge paths so that, when the boom spool is shifted for lowering the boom, the hydraulic fluid of the second hydraulic pump is not supplied to the actuator of the boom, wherein, only when the boom spool is shifted for lifting up the actuator of the boom, the hydraulic fluids from the first and second hydraulic pumps are in a confluent state via the bridge paths.

2. The hydraulic control valve according to claim 1, further comprising:

second check valves elastically supported, and configured to open and close openings disposed on both sides of the internal path of the boom spool, wherein, among the second check valves, a second check valve of the opening on a side of the cylinder paths, to which the hydraulic fluid from the supply path of the first hydraulic pump and the supply path of the second hydraulic pump is supplied, is configured to be opened to supply the hydraulic fluid to the actuator, and another second check valve of the opening on the other side is configured to be maintained in a closed state.

3. The hydraulic control valve according to claim 2, further comprising:

a relief valve disposed on an actuator port configured to communicate with the actuator and the cylinder paths to return the hydraulic fluid having an excessive pressure to a hydraulic tank when a pressure that exceeds a predetermined set pressure is generated in the actuator.

4. The hydraulic control valve according to claim 3, wherein the actuator comprises a boom cylinder or an arm cylinder.

5. The hydraulic control valve according to claim 2, wherein the first check valves or second check valves comprise:

back chambers configured to communicate with the openings disposed on the both sides of the internal path of the boom spool;

poppets slidably coupled to the back chambers, and configured to open and close the openings of the internal path;

springs elastically supporting the poppets in a closed state by pressing the poppets with respect to the openings of the internal path; and plugs fixed to the boom spool to maintain a predetermined set pressure of the springs.

6. The hydraulic control valve according to claim 5, further comprising:

drain paths disposed on the left and right sides of the boom spool, and configured to communicate with the back chambers to supply the hydraulic fluid in the supply path of the first hydraulic pump and the supply path of the second hydraulic pump to the actuator through the internal path of the boom spool, wherein, when the boom spool is shifted, the drain paths are configured to connect the back chambers with tank paths to open the poppets from the openings on the both sides of the internal path.

7. The hydraulic control valve according to claim 6, wherein the actuator comprises a boom cylinder or an arm cylinder.

8. The hydraulic control valve according to claim 5, wherein the actuator comprises a boom cylinder or an arm cylinder.

9. The hydraulic control valve according to claim 2, wherein the actuator comprises a boom cylinder or an arm cylinder.

10. The hydraulic control valve according to claim 1, wherein the first check valves comprise:

a plug in which a path configured to communicate with the supply path of the first hydraulic pump is disposed;

a first poppet elastically supported by a spring to open and close the path, comprising slots disposed on both side surfaces of the first poppet, and configured to slide against the plug; and a second poppet configured to slide to perform a relative motion with respect to the first poppet, and elastically supported by the spring to open and close the path disposed on a sliding surface of the valve block in which the boom spool is shifted.

11. The hydraulic control valve according to claim 10, wherein the actuator comprises a boom cylinder or an arm cylinder.

12. The hydraulic control valve according to claim 1, wherein the first check valves comprise:

a plug in which a path configured to communicate with the supply path of the second hydraulic pump is disposed; and a poppet elastically supported by a spring to open and close the path, comprising slots disposed on both side surfaces of the poppet, and configured to slide against the plug.

13. The hydraulic control valve according to claim 12, wherein the actuator comprises a boom cylinder or an arm cylinder.

14. The hydraulic control valve according to claim 1, wherein the actuator comprises a boom cylinder or an arm cylinder.

* * * * *